US007840165B2

(12) United States Patent
Okuda

(10) Patent No.: US 7,840,165 B2
(45) Date of Patent: Nov. 23, 2010

(54) TONER REPLENISHING APPARATUS, IMAGE FORMING APPARATUS, AND COLOR IMAGE FORMING APPARATUS

(75) Inventor: Takeshi Okuda, Kizugawa (JP)

(73) Assignee: Sharp Kabushiki Kaisha, Osaka (JP)

( * ) Notice: Subject to any disclaimer, the term of this patent is extended or adjusted under 35 U.S.C. 154(b) by 98 days.

(21) Appl. No.: 12/262,406

(22) Filed: Oct. 31, 2008

(65) Prior Publication Data

US 2009/0123191 A1 May 14, 2009

(30) Foreign Application Priority Data

Nov. 9, 2007 (JP) ..... 2007-292466

(51) Int. Cl.
*G03G 15/08* (2006.01)

(52) U.S. Cl. ..... 399/258

(58) Field of Classification Search ..... 399/258, 399/260, 262, 263

See application file for complete search history.

(56) References Cited

U.S. PATENT DOCUMENTS 4,924,920 A * 5/1990 Bhagwat ..... 141/98
5,175,588 A * 12/1992 Katagata ..... 399/106
5,794,108 A * 8/1998 Yoshizawa et al. ..... 399/262
5,822,663 A * 10/1998 Ichikawa et al. ..... 399/262
5,828,935 A * 10/1998 Tatsumi et al. ..... 399/260
5,867,757 A * 2/1999 Okazaki et al. ..... 399/262
6,014,536 A * 1/2000 Ban et al. ..... 399/258
6,289,193 B1 * 9/2001 Ban et al. ..... 399/258
6,628,913 B2 * 9/2003 Matsumoto et al. ..... 399/258
7,386,250 B2 * 6/2008 Ban et al. ..... 399/106
7,480,476 B2 * 1/2009 Hosokawa et al. ..... 399/258
7,515,855 B2 * 4/2009 Katsuyama et al. ..... 399/262
7,542,703 B2 * 6/2009 Kasahara et al. ..... 399/258
2003/0219284 A1 * 11/2003 Ishiguro et al. ..... 399/258
2004/0105703 A1 * 6/2004 Nozawa ..... 399/258
2004/0131390 A1 * 7/2004 Kita ..... 399/258
2004/0179866 A1 * 9/2004 Muramatsu et al. ..... 399/258
2005/0226657 A1 * 10/2005 Kuma et al. ..... 399/258
2005/0226658 A1 * 10/2005 Haruyama ..... 399/258
2006/0083555 A1 * 4/2006 Uchiyama et al. ..... 399/258
2006/0127129 A1 6/2006 Jung et al.
2007/0092303 A1 * 4/2007 Katsuyama et al. ..... 399/258
2007/0098455 A1 5/2007 Kuma et al.

(Continued)

FOREIGN PATENT DOCUMENTS

CN 1790193 A 6/2006

(Continued)

*Primary Examiner*—David P Porta
*Assistant Examiner*—Kiho Kim
(74) *Attorney, Agent, or Firm*—Renner, Otto, Boisselle & Sklar, LLP

(57) ABSTRACT

A toner replenishing apparatus that allows easy removal of a toner replenishing container and make contributions to downsizing of an image forming apparatus, and an image forming apparatus having the toner replenishing apparatus are provided. A toner replenishing apparatus has a displacement mechanism for displacing a toner replenishing container from a position with the toner replenishing container held by a container holding member. The displacement mechanism includes a hook portion formed in a retaining member and an engagement portion formed in the toner replenishing container. The displacement mechanism effects displacement of the toner replenishing container in conjunction with a release of the toner replenishing container from a retaining action of the retaining member.

9 Claims, 9 Drawing Sheets

U.S. PATENT DOCUMENTS

| | | | | |
|---|---|---|---|---|
| 2007/0223947 | A1 | 9/2007 | Ohkawa et al. | |
| 2007/0269236 | A1* | 11/2007 | Takuwa | 399/258 |
| 2008/0101821 | A1* | 5/2008 | Gayne et al. | 399/258 |

FOREIGN PATENT DOCUMENTS

| | | | |
|---|---|---|---|
| CN | 101046657 | A | 10/2007 |
| JP | 09-171289 | | 6/1997 |
| JP | 09-329953 | | 12/1997 |
| JP | 2005-242203 | | 9/2005 |
| JP | 2007-041104 | | 2/2007 |

* cited by examiner

100

18
17
17
50
1
2
3
4
16
16
51
5
6b
S
6a
R
R
7
7
7
7
8
41
27
40
6
22
27
22
27
22
27
22
15
15
9
10
11
12
14
15
P
13
15

TONER REPLENISHING APPARATUS, IMAGE FORMING APPARATUS, AND COLOR IMAGE FORMING APPARATUS

CROSS-REFERENCE TO RELATED APPLICATION

This application claims priority to Japanese Patent Application No. 2007-292466, which was filed on Nov. 9, 2007, the contents of which are incorporated herein by reference in its entirety.

BACKGROUND OF THE INVENTION

1. Field of the Invention

The present invention relates to a toner replenishing apparatus for replenishing toner to a developing device for developing a latent image with use of a developer containing toner, and to an image forming apparatus having the toner replenishing apparatus, for example, a copying machine, a printer, and a facsimile apparatus.

2. Description of the Related Art

In an image forming apparatus, instead of replenishment of toner in a toner hopper disposed within a developing device from a toner bottle, replacement of an empty toner replenishing container with a new one has come to be the favored method of toner replenishment because of its advantage of protecting user's hands from being contaminated by toner.

There are known two types of image forming apparatuses having attached thereto a removable toner replenishing container: an image forming apparatus that adopts a method for removing its toner replenishing container by opening a top cover of the apparatus main body; and an image forming apparatus that adopts a method for removing its toner replenishing container by opening a front cover of the apparatus main body. In constructing an image forming apparatus in which an expendable component is replaced with a new one by a user on his/her own, the former type is superior to the latter type from the standpoints of easiness in looking in the apparatus main body, easiness in replacing expendable components, and easiness in cleaning, etc.

In the image forming apparatus of the former type, the toner replenishing container needs to be lifted up for its removal from the upper part of the apparatus main body. In order to facilitate the removal of the toner replenishing container from the image forming apparatus main body, some contrivance to obtain an easy-to-hold toner replenishing container has been made such as, for example, as disclosed in Japanese Unexamined Patent Publication JP-A 9-329953 (1997) (refer to page 3, FIG. 2), placement of a grip on the upper part of the toner replenishing container and widening of a space around the toner replenishing container.

However, in a case where, as disclosed in JP-A 9-329953, a grip is attached to the upper part of the toner replenishing container or a space around the toner replenishing container is widened, a larger room is required for housing the toner replenishing container, which gives rise to a problem of an increase in the size of the image forming apparatus. Meanwhile, in a case where the capacity of the toner replenishing container is reduced to achieve downsizing of the image forming apparatus, the number of toner-replenishing-container replacement is increased, which gives rise to a problem of wasting user's time.

In a color image forming apparatus in which are housed a plurality of toner replenishing containers, each of the toner replenishing containers needs to be housed in a narrow space to achieve miniaturization. Therefore, restrictions are placed on the capacity of the toner replenishing container. In such a color image forming apparatus, if, as disclosed in JP-A 9-329953, a grip is attached to the upper part of the toner replenishing container or a space around the toner replenishing container is widened, there arises a problem that severer restrictions need to be imposed on the capacity of the toner replenishing container.

SUMMARY OF THE INVENTION

An object of the invention is to provide a toner replenishing apparatus that allows easy removal of a toner replenishing container and make contributions to downsizing of an image forming apparatus, and an image forming apparatus having the toner replenishing apparatus.

The invention provides a toner replenishing apparatus comprising:

a toner replenishing container for accommodating toner to be replenished to a developing device;

a container holding member for holding the toner replenishing container in a detachable manner; and a displacement mechanism for displacing the toner replenishing container from a position where the toner replenishing container is held by the container holding member.

According to the invention, by the displacement mechanism, the toner replenishing container is displaced from the position where it is held by the container holding member. This helps facilitate the removal of the toner replenishing container from the container holding member, wherefore the need to form a grip in the toner replenishing container for ease in its removal from the container holding member can be eliminated. In addition, there is no need to create an extra space between the toner replenishing container and the container holding member for ease in the removal of the toner replenishing container. Accordingly, in contrast to a conventional art construction, the toner replenishing apparatus can be down-sized. With the provision of such a toner replenishing apparatus embodying the invention, it is possible to reduce the size of the image forming apparatus.

In the invention, it is preferable that the toner replenishing apparatus further includes a retaining member for retaining the toner replenishing container securely in the container holding member, and the displacement mechanism effects displacement of the toner replenishing container in conjunction with a release of the toner replenishing container from a retaining action of the retaining member.

According to the invention, the displacement mechanism operates in conjunction with the release of the toner replenishing container from the retaining action of the retaining member. That is, the release of the toner replenishing container from the retaining action of the retaining member and the displacement of the toner replenishing container by the displacement mechanism can be effected at a single stroke. Accordingly, as compared with a case where the displacement mechanism does not operate in conjunction with the release of the toner replenishing container from the retaining action of the retaining member, the toner replenishing container can be removed more easily.

Moreover, in the invention, it is preferable that the displacement mechanism includes a hook portion formed in the retaining member and an engagement portion formed in the toner replenishing container, the engagement portion being engaged with the hook portion under a condition that the toner replenishing container is released from the retaining action of the retaining member.

According to the invention, the displacement mechanism effects displacement of the toner replenishing container by causing the hook portion formed in the retaining member to be engaged with the engagement portion formed in the toner replenishing container. In this way, the displacement mechanism can be designed in a simple configuration.

Moreover, in the invention, it is preferable that the retaining member is turnably supported by the container holding member, and the toner replenishing container is released from a retaining action by a turning movement of the retaining member with respect to the container holding member.

According to the invention, by the turning movement of the retaining member with respect to the container holding member, the toner replenishing container is released from a retaining action and the hook portion formed in the retaining member is engaged with the engagement portion formed in the toner replenishing container thereby to displace the toner replenishing container. In this way, the displacement mechanism can be designed in a simpler configuration.

Moreover, in the invention, it is preferable that the container holding member is formed in a shape of a housing having a bottom portion and a wall portion with its one side opened, the bottom portion has a placement surface portion on which is placed the toner replenishing container while being retained in place by the retaining member, the wall portion has a guide portion merged with the placement surface portion for guiding the toner replenishing container in a direction toward the opened side of the container holding member and a support portion merged with the guide portion for supporting the retaining member, the displacement mechanism further includes the guide portion, and the hook portion and the engagement portion are engaged with each other to displace the toner replenishing container in the direction toward the opened side of the container holding member.

According to the invention, on the placement surface portion of the bottom portion of the housing-shaped container holding member is placed the toner replenishing container while being retained in place by the retaining member. The toner replenishing container is released from a retaining action by a turning movement of the retaining member supported by the support portion formed on the side wall portion of the container holding member. Then, the hook portion and the engagement portion of the displacement mechanism are engaged with each other in conjunction with the turning movement of the retaining member with respect to the container holding member. Whereupon, the toner replenishing container is guided by the guide portion so as to be displaced in the direction toward the opened side of the container holding member. In this way, the toner replenishing container can be displaced smoothly in the direction toward the opened side of the container holding member. Moreover, it is possible to prevent interruption of displacement of the toner replenishing container and thereby allow the toner replenishing container to be displaced in the direction toward the opened side of the container holding member more reliably. Further, since the toner replenishing container is displaced in the direction toward the opened side of the container holding member by the displacement mechanism, it is possible to make its removal from the container holding member easier.

Moreover, in the invention, it is preferable that the guide portion has a slant part which merges with the placement surface portion and is inclined to the placement surface portion, and a horizontal part which merges with the slant part and is parallel to the placement surface portion.

According to the invention, the toner replenishing container is guidedly moved along the slant part of the guide portion in the direction toward the opened side of the container holding member in conjunction with the turning movement of the retaining member with respect to the container holding member. Since the horizontal part merges with the slant part, it follows that the toner replenishing container having been displaced along the slant part in the direction toward the opened side of the container holding member is retained at the horizontal part. This makes it possible to prevent the displaced toner replenishing container from sliding off along the slant part again and thereby keep the toner replenishing container at its displacement position. Accordingly, the toner replenishing container can be removed more easily. For example, a person in charge of operation is able to take out the toner replenishing container with his/her hands kept away from the retaining member. That is, the toner replenishing container-removal operation can be conducted with one hand.

Moreover, in the invention, it is preferable that the slant part is formed in a curved-surface configuration, and its inclination angle with respect to the placement surface portion becomes larger as a distance from a virtual plane including the placement surface portion becomes larger.

According to the invention, along the curved surface-shaped slant part in which the inclination angle with respect to the placement surface portion becomes larger as a distance from a virtual plane including the placement surface portion becomes larger, the toner replenishing container is guidedly displaced. In this way, the toner replenishing container can be displaced smoothly in the direction toward the opened side of the container holding member. Moreover, with the provision of the curved surface-shaped slant part in which the inclination angle with respect to the placement surface portion becomes larger gradually with decreasing proximity to a virtual plane including the placement surface portion, it is possible to prevent interruption of displacement of the toner replenishing container more reliably and thereby allow the toner replenishing container to be displaced in the direction toward the opened side of the container holding member more reliably.

Moreover, in the invention, it is preferable that the toner replenishing container has a toner replenishing section which is driven to rotate about a predetermined axis of rotation, for replenishing toner to the developing device, and a container-side juncture for transmitting a rotational drive force to the toner replenishing section, the container holding member has a holding member-side juncture which is coupled to the container-side juncture, in a state where the toner replenishing container is retained in the container holding member, to transmit a rotational drive force to the container-side juncture, and a coupling between the container-side juncture and the holding member-side juncture is disengaged in conjunction with the displacement of the toner replenishing container by the displacement mechanism.

According to the invention, with the toner replenishing container retained in the container holding member, a rotational drive force is transmitted to the toner replenishing section via the holding member-side juncture and the container-side juncture. Whereupon, the toner replenishing section is driven to rotate about the axis of rotation thereby to replenish toner to the developing device. The coupling between the container-side juncture and the holding member-side juncture is disengaged as the toner replenishing container is displaced by the displacement mechanism. That is, the disengagement of the container-side juncture-to-the holding member-side juncture coupling and the displacement of the toner replenishing container by the displacement mechanism can be effected at a single stroke. Accordingly, the toner replenishing container can be removed more easily.

Moreover, in the invention, it is preferable that the toner replenishing apparatus further includes a shutter section for opening and closing a toner replenishing port which is formed in the toner replenishing container for replenishing toner to the developing device, and the shutter section brings the toner replenishing port into a closed state in conjunction with the displacement of the toner replenishing container by the displacement mechanism.

According to the invention, the toner replenishing port formed in the toner replenishing container is opened and closed by the shutter section. The shutter section brings the toner replenishing port into a closed state in conjunction with the displacement of the toner replenishing container by the displacement mechanism. Therefore, in a state where the toner replenishing container is displaced from its retained position by the displacement mechanism, the toner replenishing port is kept in a closed state. This makes it possible to prevent toner leakage through the toner replenishing port and thereby take the toner replenishing container out without causing any contamination due to toner. Accordingly, the toner replenishing container can be removed more easily.

Moreover, the invention provides an image forming apparatus comprising:

an image bearing member on which is to be formed a latent image;

a latent-image forming section for forming a latent image on the image bearing member;

a developing device for developing the latent image formed on the image bearing member with use of toner; and the toner replenishing apparatus of the invention for replenishing toner to the developing device.

According to the invention, there is constructed the image forming apparatus provided with the above-stated toner replenishing apparatus that allows easy removal of the toner replenishing container and can be made compact. Accordingly, it is possible to realize a compact image forming apparatus that allows easy replacement of the toner replenishing container.

Moreover, the invention provides a color image forming apparatus comprising:

a plurality of image bearing members on each of which is to be formed a latent image;

a plurality of latent-image forming sections each for forming a latent image on the image bearing member;

a plurality of developing devices each for developing the latent image formed on the image bearing member with use of toner, the toners used for the respective developing devices being of different colors from each other;

a plurality of toner replenishing containers each for accommodating toner to be replenished to a developing device corresponding thereto;

a container holding member for holding the plurality of toner replenishing containers in a detachable manner; and a plurality of displacement mechanisms each for displacing the corresponding toner replenishing container from a position where the corresponding toner replenishing container is held by the container holding member.

According to the invention, there is constructed the color image forming apparatus that allows easy removal of the toner replenishing containers and can be made compact. Accordingly, it is possible to realize a compact color image forming apparatus that allows easy replacement of the toner replenishing containers.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
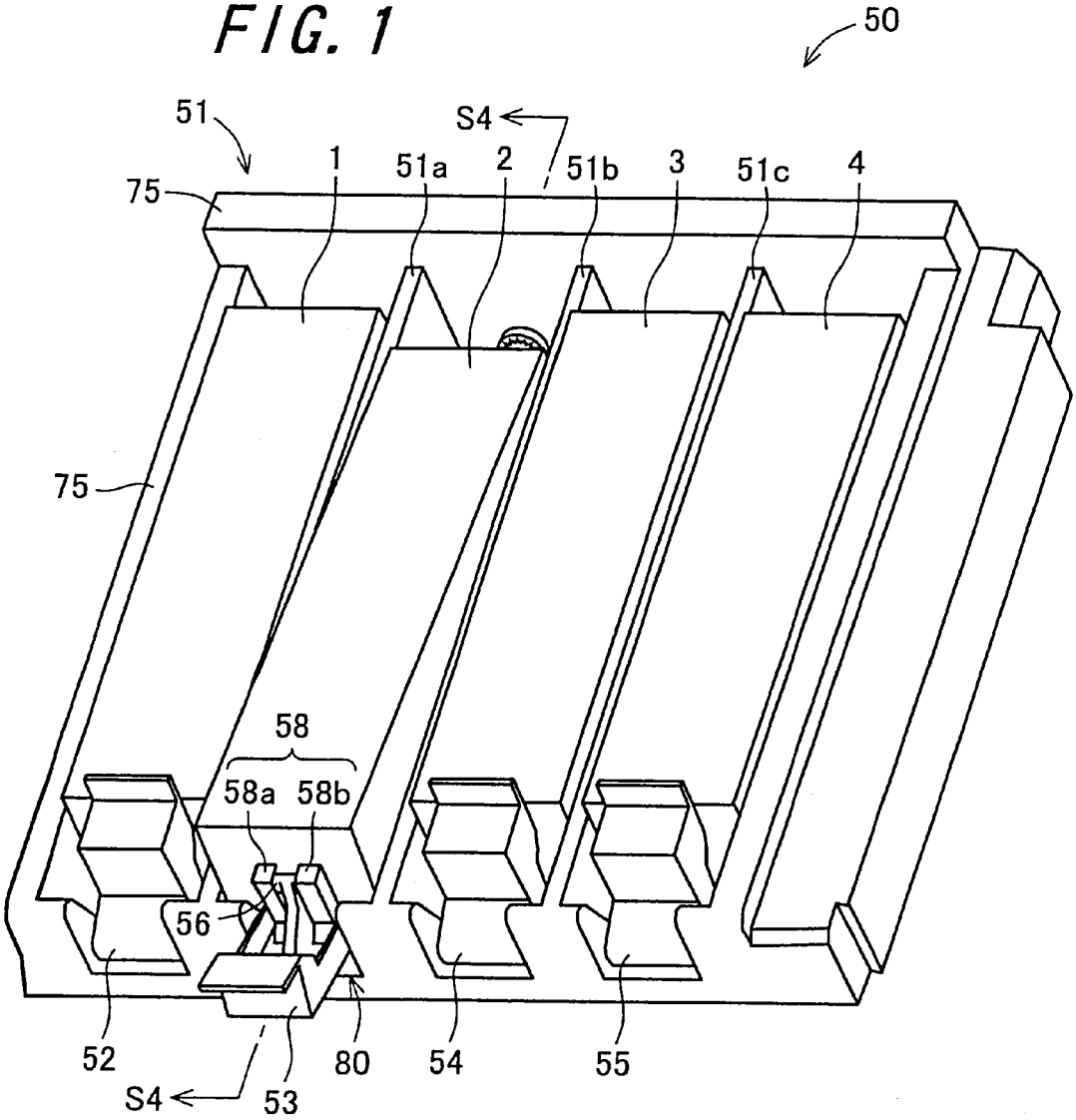
FIG. 1 is a perspective view showing a toner replenishing apparatus in accordance with one embodiment of the invention.

Now referring to the drawings, preferred embodiments of the invention are described below.

Figure 2:
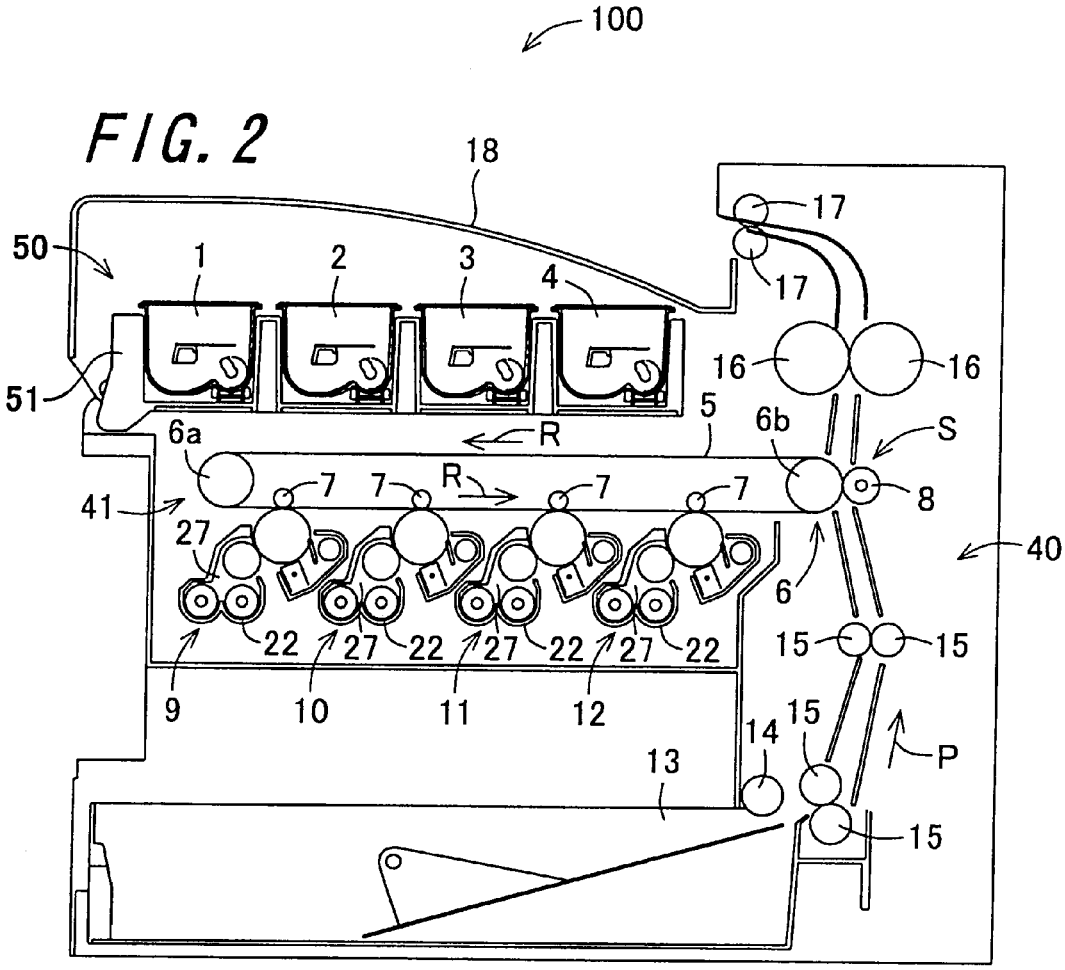
FIG. 2 is a schematic view showing the structure of an image forming apparatus having the toner replenishing apparatus.
Figure 3:
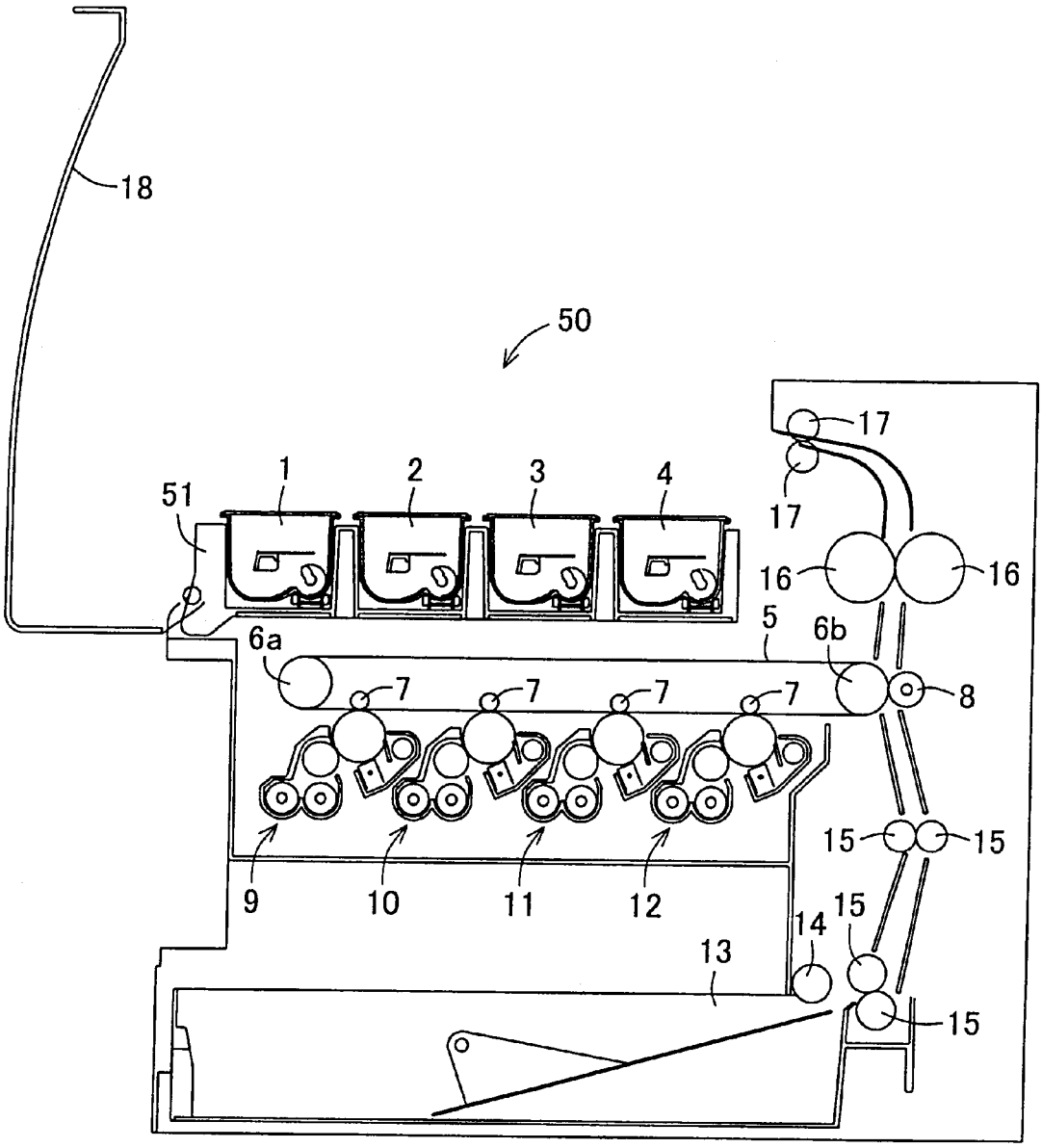
FIG. 3 is a schematic view showing the image forming apparatus, with its top cover left open.

FIG. 1 is a perspective view showing a toner replenishing apparatus 50 in accordance with one embodiment of the invention. FIG. 2 is a schematic view showing the structure of an image forming apparatus 100 having the toner replenishing apparatus 50. FIG. 3 is a schematic view showing the image forming apparatus 100, with its top cover 18 left open. In FIGS. 2 and 3, in order to simplify an understanding of the invention, the thickness of the construction is partly omitted.

The toner replenishing apparatus 50 comprises a plurality of toner replenishing containers, specifically, in this embodiment, four toner replenishing containers, namely a first toner replenishing container 1, a second toner replenishing container 2, a third toner replenishing container 3, and a fourth toner replenishing container 4; a container holding member 51 for holding these toner replenishing containers 1 to 4 in a detachable manner; and a plurality of retaining members 52, 53, 54 and 55 for retaining the toner replenishing containers 1 to 4 securely in the container holding member 51. The retaining members 52 to 55 correspond in number with the toner replenishing containers 1 to 4 so as to retain their respective toner replenishing containers 1 to 4 securely in the container holding member 51. In this embodiment, for the sake of the first to fourth toner replenishing containers 1 to 4, there are provided the retaining members 52 to 55, which are correspondingly four in number, namely the first to fourth retaining members 52 to 55.

Each of the toner replenishing containers 1 to 4 accommodates toner to be replenished to a developing device 22 to be described hereinafter, disposed in the image forming apparatus 100, specifically, a developer tank 27 of the developing device 22. The toner replenishing containers 1 to 4 correspond in number with the developing devices 22 so as to replenish toner to their respective developing devices 22. In this embodiment, the image forming apparatus 100 has a plurality of developing devices 22, specifically, four developing devices 22, that develop latent images with use of developers containing toners of different colors, respectively. The toner replenishing containers 1 to 4 replenish toners to their respective developer tanks 27 of the developing devices 22. The toner accommodated in each of the toner replenishing containers 1 to 4 is replenished, through a non-illustrated toner conveyance path, to the corresponding developing device 22.

With the image forming apparatus 100 emplaced on a horizontal plane, the toner replenishing apparatus 50 is mounted in the image forming apparatus 100 in such a manner that the toner replenishing containers 1 to 4 are arranged above the container holding member 51 and a bottom portion 76 of the container holding member 51 is placed horizontally. With the image forming apparatus 100 emplaced on a horizontal plane, the toner replenishing apparatus 50 is located above an intermediate transfer belt 5 to be described hereinafter. As shown in FIG. 2, in a state where the top cover 18 of the image forming apparatus 100 is closed, the toner replenishing apparatus 50 is covered with the top cover 18. As shown in FIG. 3, in a state where the top cover 18 of the image forming apparatus 100 is opened, the toner replenishing containers 1 to 4 can be taken out of the image forming apparatus 100.

As shown in FIG. 1, the container holding member 51 has four housing spaces created by arranging three partition plates 51*a*, 51*b* and 51*c*. The first toner replenishing container 1, the second toner replenishing container 2, the third toner replenishing container 3, and the fourth toner replenishing container 4 are retained separately in the individual spaces of the container holding member 51. In the spaces of the container holding member 51 are disposed the above-described retaining members 52 to 55, respectively, for retaining their respective toner replenishing containers 1 to 4 in place.

Figure 4:
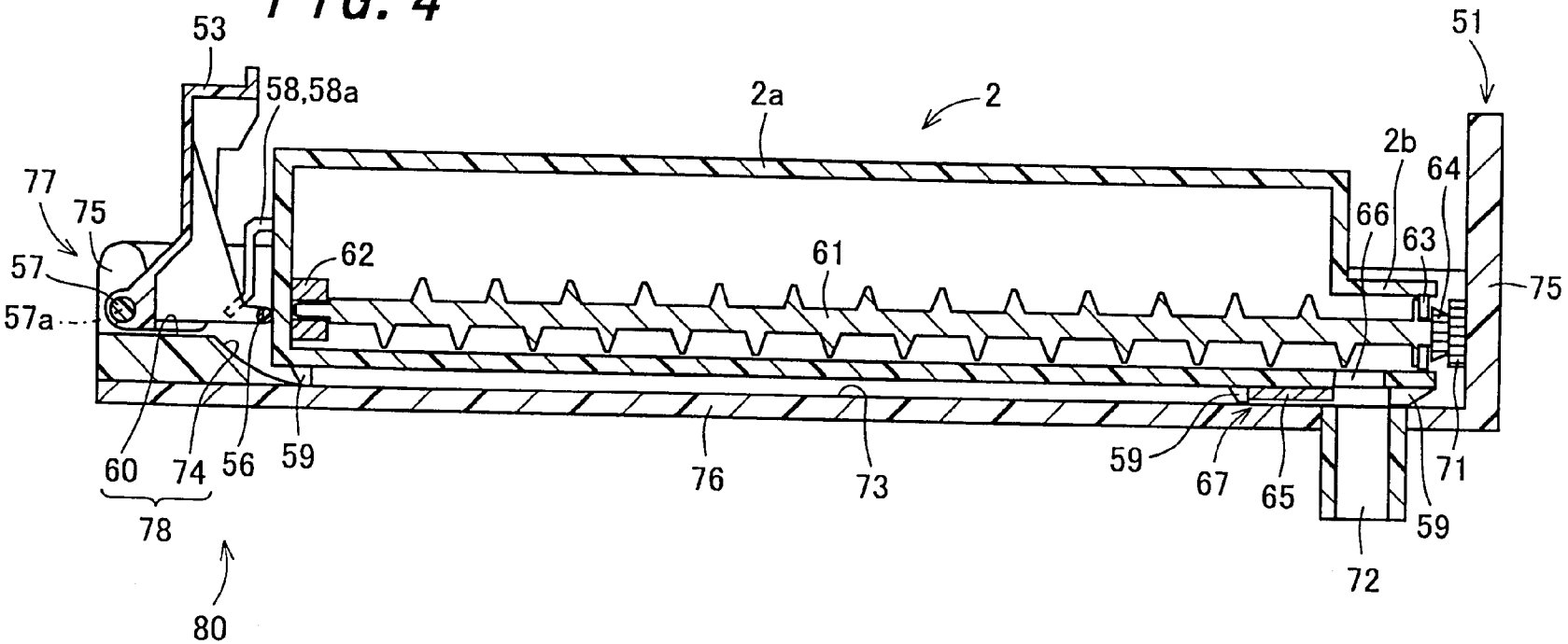
FIG. 4 is a sectional view taken along a section line S4-S4 depicted in FIG. 1.
Figure 5:
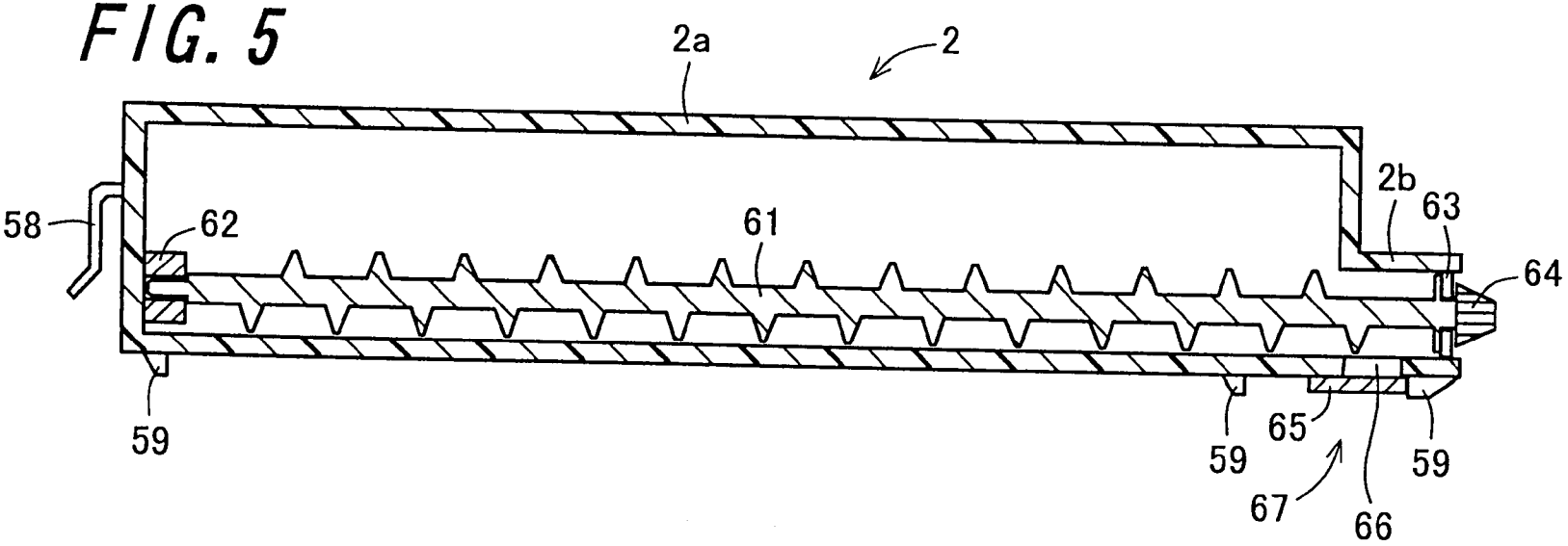
FIG. 5 is a sectional view showing a second toner replenishing container in a state of being separated from a container holding member.
Figure 6:
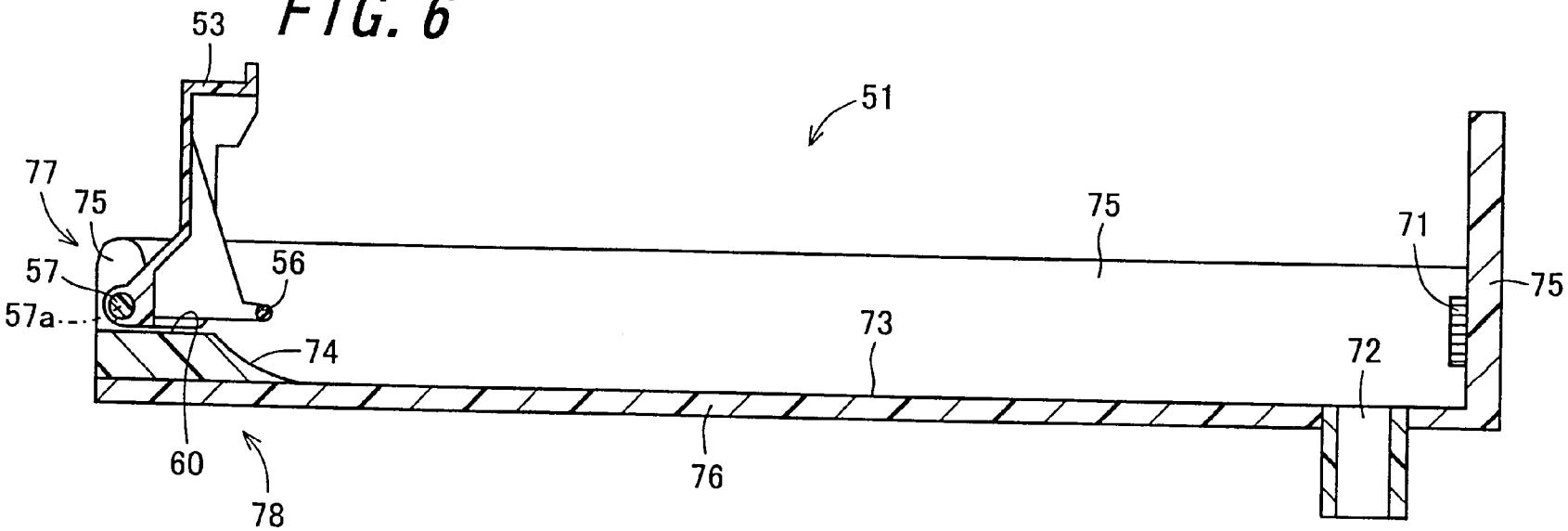
FIG. 6 is a sectional view showing the container holding member, with the first to fourth toner replenishing containers removed.

FIG. 4 is a sectional view taken along a section line S4-S4 depicted in FIG. 1. There is shown in FIG. 4 a state where the second toner replenishing container 2 is retained securely in the container holding member 51 by the second retaining member 53. FIG. 4 is a sectional view of the construction as seen from a virtual plane along which a first engaging pawl 58*a* and a second engaging pawl 58*b* of an engagement portion 58 formed in the second toner replenishing container 2 are sectioned in a plane-symmetrical manner. FIG. 5 is a sectional view showing the second toner replenishing container 2 in a state of being separated from the container holding member 51. FIG. 6 is a sectional view showing the container holding member 51, with the first to fourth toner replenishing containers 1 to 4 removed. FIGS. 5 and 6 each correspond to a sectional view taken along the section line S4-S4 depicted in FIG. 1.

The first toner replenishing container 1, the third toner replenishing container 3, and the fourth toner replenishing container 4 are each similar to the second toner replenishing container 2 in construction and in mechanism for retaining the container securely in the container holding member 51, and therefore the descriptions thereof will be omitted. Hereinafter, in a case where there is no need to make a positive distinction among the first to fourth toner replenishing containers 1 to 4, they are collectively referred to simply as "toner replenishing container".

The toner replenishing container 2 includes a container main body 2*a* for accommodating toner; a toner replenishing roller 61 housed in the container main body 2*a*, for effecting toner replenishing operation when driven to rotate about its axis; and a toner replenishing port shutter member 65 for bringing a toner replenishing port 66, through which toner is replenished, into an open state and a closed state. With the toner replenishing container 2 placed on a horizontal plane, the toner replenishing port 66 is formed in a lower part of the container main body 2*a* so as to face axially one end of the toner replenishing roller 61. In FIGS. 4 to 6, in order to simplify an understanding of the invention, the opening which defines the toner replenishing port 66 is represented by a reference numeral 66.

The toner replenishing roller 61 corresponds to the toner replenishing section. In this embodiment, the toner replenishing roller 61 is designed in the form of a paddle roller having paddle-shaped blades. The toner replenishing roller 61 has, at its axially one end, a container-side juncture 64 for transmitting a rotational drive force to the toner replenishing roller 61. The container-side juncture 64 is coupled to a holding member-side juncture 71 formed in the container holding member 51. The toner replenishing roller 61 receives application of a rotational drive force from the image forming apparatus 100 main body via the container-side juncture 64 and the holding member-side juncture 71. The toner replenishing roller 61 is supported by a first juncture bearing 62 and a second juncture bearing 63 disposed within the container main body 2*a*. The container-side juncture 64 is closer to axially one side of the toner replenishing roller 61 than the second juncture bearing 63 for supporting one end of the toner replenishing roller 61 is. Hereinafter, a direction axially of the toner replenishing roller 61 is defined as "axial direction".

The container main body 2*a* is formed in the shape of a hollow, substantially rectangular prism. With the toner replenishing container 2 placed on a horizontal plane, the container main body 2*a* has, at axially one end of its lower part, a narrowed-down portion 2*b* which is made smaller than the rest part of the container main body 2*a* in cross-sectional area when viewed in a direction perpendicular to the axis thereof. The second juncture bearing 63 is disposed at axially one end of the narrowed-down portion 2*b*. The first juncture bearing 62 is disposed in the container main body 2*a* so as to be located opposite the second juncture bearing 63 in the axial direction.

The toner replenishing port shutter member 65 is included in a toner replenishing port shutter section 67. The toner replenishing port shutter section 67 includes, in addition to the toner replenishing port shutter member 65, a shutter guide portion, a shutter displacement portion, and a closed-position keeping portion that are not shown in the figure. The toner replenishing port shutter member 65 is supported by the shutter guide portion so as to be slidingly displaceable in a direction parallel to axis of the toner replenishing roller 61. The shutter guide portion is disposed in the lower part of the container main body 2*a*. The toner replenishing port shutter member 65 is slidingly displaceable along the shutter guide portion between a closed position where the toner replenishing port 66 is placed in a closed state and an open position where the toner replenishing port 66 is placed in an open state.

The shutter displacement portion for allowing sliding displacement of the toner replenishing port shutter member 65 is disposed in the container holding member 51. For example, the shutter displacement portion is realized by using an actuating pin. Upon the toner replenishing container 2 being set in a specified position, specifically, in this embodiment, a position such that the container-side juncture 64 and the holding member-side juncture 71 are coupled to each other, by the shutter displacement portion, the toner replenishing port shutter member 65 kept in the closed position is slidingly displaced to assume the open position. As a result, the toner replenishing port 66 is brought into the open state.

The closed-position keeping portion, which keeps the toner replenishing port shutter member 65 in the closed position at a location where the toner replenishing port shutter member 65 is away from the shutter displacement portion, is disposed in the toner replenishing container 2. For example, the closed-position keeping portion is realized by using a coil spring. When the toner replenishing container 1 is taken out of the container holding member 51 and removed from a main body of the image forming apparatus 100, by the closed-position keeping portion, the toner replenishing port shutter member 65 is slidingly displaced to assume the closed position. As a result, the toner replenishing port 66 is brought into the closed state.

With the toner replenishing container 2 placed on a horizontal plane, the container main body 2*a* has, in its lower part, a bottom-face projection 59 for supporting the toner replenishing container 2 by making contact with the container holding member 51 and also reducing resistance of friction between the toner replenishing container 2 and the container holding member 51. In this embodiment, there are provided three pieces of the bottom-face projections 59 that are disposed at axially one end of the container main body 2*a*, axially the other end thereof, and a position located nearer axially the other side of the container main body 2*a* in relation to the narrowed-down portion 2*b*, respectively. Moreover, the container main body 2*a* has, on a side surface at axially the other end thereof, namely on a side surface opposite from the side surface on which is disposed the container-side juncture 64, the engagement portion 58 for locking the retaining member 53.

The container holding member 51 takes the form of a substantially rectangular-parallelepiped housing with its one side opened. The container holding member 51 has a wall portion 75 extending circumferentially thereof and the bottom portion 76 formed so as to cover one side of the wall portion 75. On the bottom portion 76 of the container holding member 51 is formed a toner receiving port 72 for receiving toner replenished from the toner replenishing container 2. The toner receiving port 72 is formed on that part of the bottom portion 76 on which is housed each of the toner replenishing containers 1 to 4.

The container holding member 51 has, on its wall portion 75 which faces, in a state where the toner replenishing container 2 is mounted in the container holding member 51, the container-side juncture 64 of the toner replenishing container 2, the holding member-side juncture 71 which is coupled to the container-side juncture 64 thereby to effect transmission of a rotational drive force from the image forming apparatus 100 main body. Moreover, the container holding member 51 has, on its wall portion 75 opposite from the wall portion 75 on which is formed the holding member-side juncture 71, a support portion 77 for supporting the retaining member 53 for retaining the toner replenishing container 2 in place.

The container holding member 51 has, on its bottom portion 76, a placement surface portion 73 on which is placed the toner replenishing container 2 while being retained in place by the retaining member 53. The toner replenishing container 2 can be retained in the container holding member 51 under a condition of being placed on the placement surface portion 73. The position of the toner replenishing container 2 in a state of being placed on the placement surface portion 73 is called "the position with the toner replenishing container 2 retained by the container holding member 51". The placement surface portion 73 serves to support the bottom-face projection 59 disposed on the lower surface portion of the container main body 2*a* of the toner replenishing container 2 and serves also to guide the toner replenishing container 2 in such a manner that the container-side juncture 64 can be coupled to the holding member-side juncture 71 at the time of attachment of the toner replenishing container 2.

Positioning for the toner replenishing container 2 is effected by means of a side plate and a bottom plate arranged so as to surround the toner replenishing container 2. That is, the toner replenishing container 2 is positioned by the first partition plate 51*a*, the second partition plate 51*b*, and the wall portion 75 facing the toner replenishing container 2 that are each a side plate surrounding the toner replenishing container 2, and the bottom portion 76 facing the toner replenishing container 2 that is a bottom plate surrounding the toner replenishing container 2. The first partition plate 51*a* and the second partition plate 51*b* are arranged, at a spacing which is slightly larger than the outside dimension of the toner replenishing container 2 in a direction perpendicular to the axial direction (hereafter referred to as "the widthwise direction"), side by side in the widthwise direction on the bottom portion 76. By disposing the first and second partition plates 51*a* and 51*b* on the bottom portion 76 in accordance with such an arrangement, it is possible to provide the placement surface portion 73 for guiding the toner replenishing container 2 in such a manner that the container-side juncture 64 can be coupled to the holding member-side juncture 71 at the time of attachment of the toner replenishing container 2.

On the wall portion 75 opposite from the wall portion 75 on which is formed the holding member-side juncture 71, namely, on the wall portion 75 on which is formed the support portion 77, is formed a guide portion 78 for guiding the toner replenishing container 2 in a direction toward the opened side of the container holding member 51 at the time of detachment of the toner replenishing container 2. The guide portion 78 merges with the placement surface portion 73 and the support portion 77. With the image forming apparatus 100 emplaced on a horizontal plane, the container holding member 51 takes on an open-topped structure. Therefore, the guide portion 78 allows the toner replenishing container 2 to be guidedly moved upward from the placement surface portion 73, expressed differently, the guide portion 78 allows the toner replenishing container 2 to be lifted up. The guide portion 78 guides the toner replenishing container 2 upwardly by guiding the bottom-face projection 59 of the toner replenishing container 2.

The guide portion 78 includes a slant part 74 which merges with the placement surface portion 73 and is inclined to the placement surface portion 73, and a horizontal part 60 which merges with the slant part 74 and is parallel to the placement surface portion. The toner replenishing container 2 is guidedly moved along the slant part 74 of the guide portion 78 in the direction of the opened side of the container holding member 51, so that it is displaceable in the direction of the opened side of the container holding member 51. The horizontal part 60 is closer to the bottom portion 76 than the support portion 77 is.

The retaining member 53, which is coupled to the support portion 77 via a rotary shaft 57, is supported by the support portion 77 so as to be rotationally movable about an axis of rotation 57*a* of the rotary shaft 57. In the retaining member 53 is formed a hook portion 56 having a cylindrical-shaped front end for pressing the toner replenishing container 2. The hook portion 56 is formed in the shape of a circular cylinder, the axis of which is kept in parallel with the axis of rotation 57*a* of the retaining member 53. The retaining member 53 retains the toner replenishing container 2 in place, with the container-side juncture 64 coupled to the holding member-side juncture 71, by pressing the toner replenishing container 2 with the hook portion 56.

In other words, with the toner replenishing container 2 retained securely in the container holding member 51 by the retaining member 53, as shown in FIG. 4, the container-side juncture 64 is coupled to the holding member-side juncture 71. Through the container-side juncture 64 and the holding member-side juncture 71, the toner replenishing roller 61 receives application of a rotational drive force from the image forming apparatus 100 main body, and the toner replenishing roller 61 is rotated under this rotational drive force. By the toner replenishing roller 61, the toner conveyed to the toner replenishing port 66 is caused to pass through the toner receiving port 72 to be supplied to an image forming unit 10. For example, the toner replenishing container 2 is so designed that the toner contained therein is supplied to the second image forming unit 10 through the toner replenishing port 66, the toner receiving port 72, and a non-illustrated toner conveyance path.

The hook portion 56 formed in the retaining member 53 and the engagement portion 58 formed in the toner replenishing container 2 constitute a displacement mechanism 80. In this embodiment, the displacement mechanism 80 further includes the guide portion 78 formed in the container holding member 51. The displacement mechanism 80 displaces the toner replenishing container 2 from the position with the toner replenishing container 2 retained by the container holding member 51. In this embodiment, the displacement mechanism 80 effects displacement of the toner replenishing container 2 in conjunction with a release of the toner replenishing container 2 from a retaining action of the retaining member 53. Hereinafter, a state where the toner replenishing container 2 is released from the retaining action of the retaining member 53 is referred to as "the release state", and the position of the retaining member 53 in the release state is referred to as "the release position". On the other hand, as has already been described with reference to FIG. 4, a state where the toner replenishing container 2 is retained in place by the retaining member 53 is referred to as "the retaining state", and the position of the retaining member 53 in the retaining state is referred to as "the retaining position".

Figure 7:
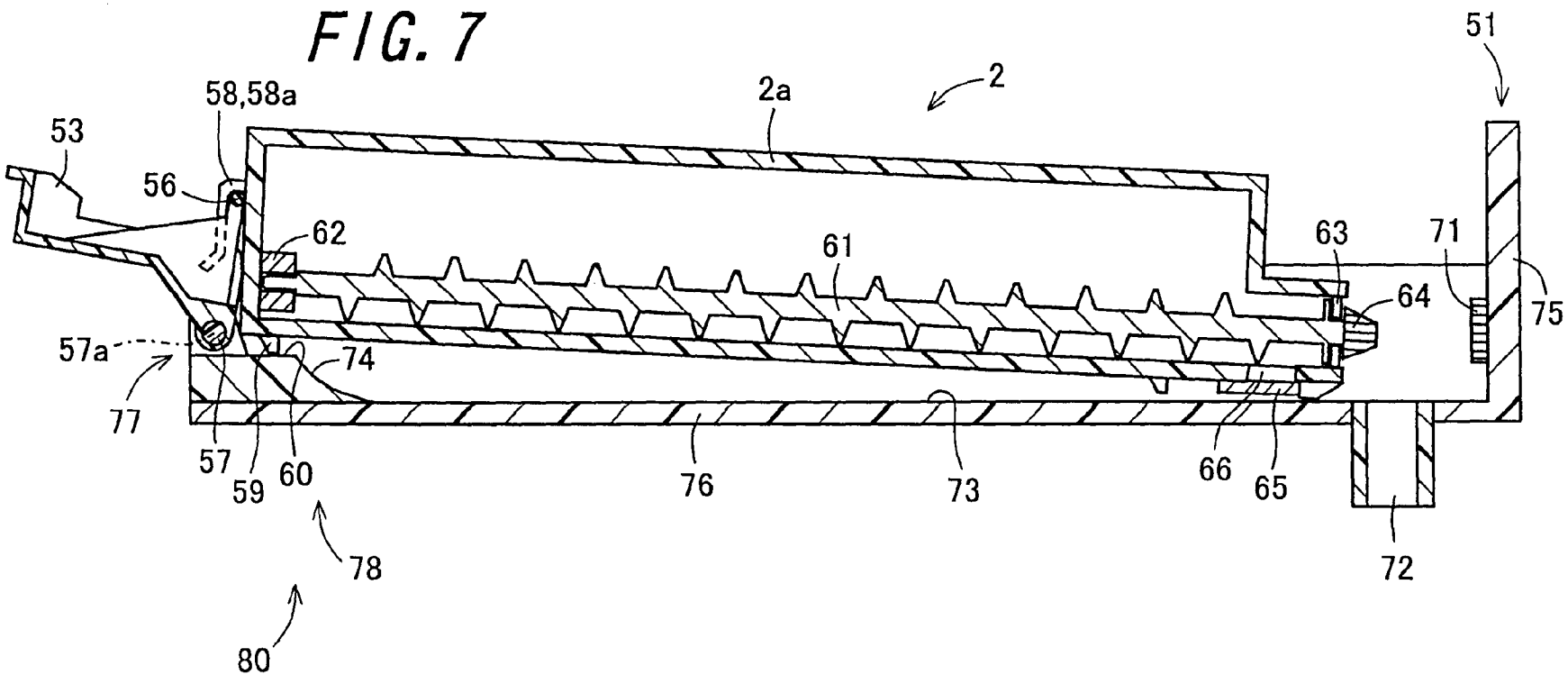
FIG. 7 is a sectional view showing the toner replenishing container and the container holding member in a release state.
Figure 8:
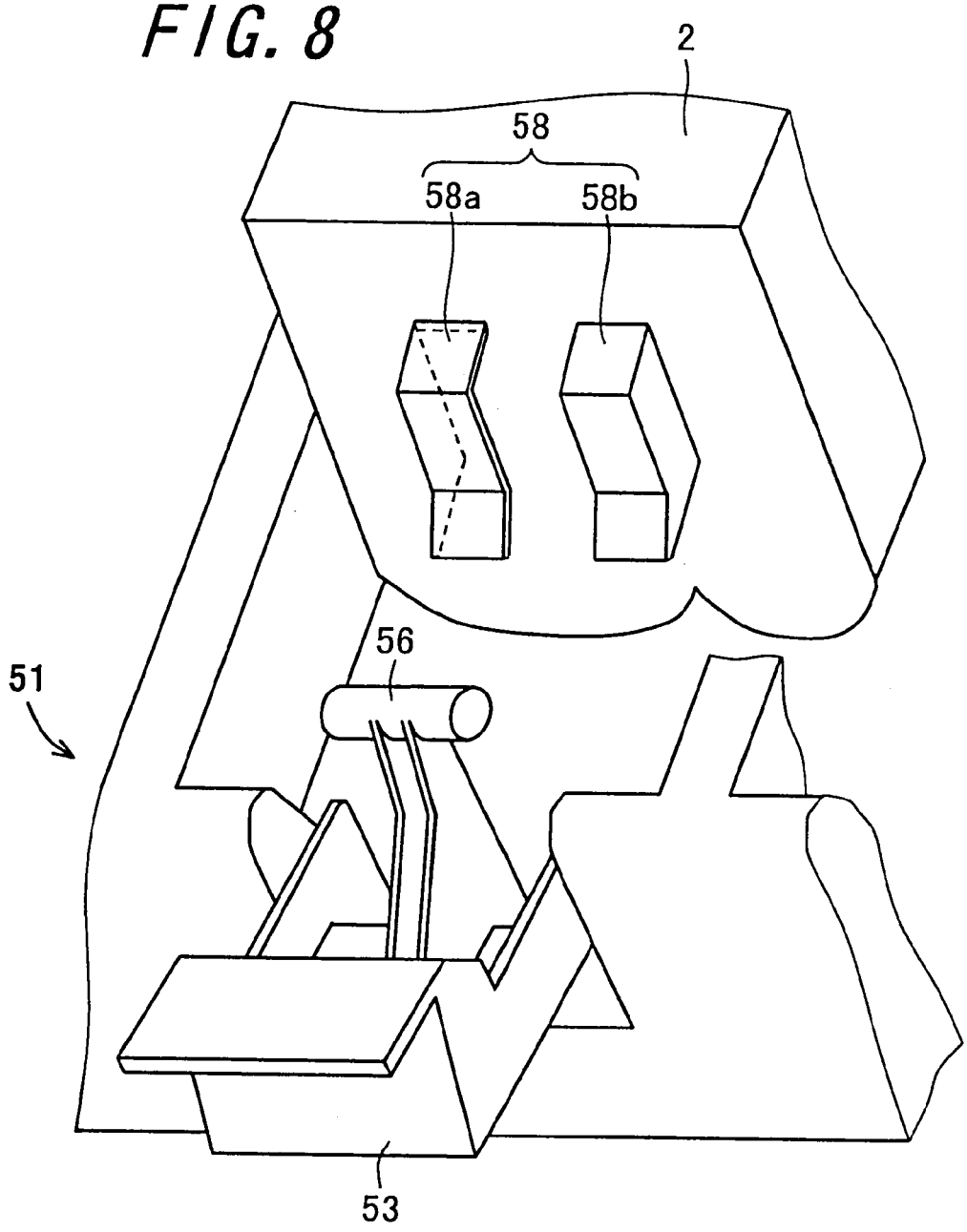
FIG. 8 is an enlarged partial perspective view showing a retaining member and an engagement portion of the toner replenishing container in a release state.

FIG. 7 is a sectional view showing the toner replenishing container 2 and the container holding member 51 in the release state. FIG. 8 is an enlarged partial perspective view showing the retaining member 53 and the engagement portion 58 of the toner replenishing container 2 in the release state. FIG. 8 corresponds to an enlarged partial perspective view of part of the toner replenishing apparatus 50 in the vicinity of the second retaining member 53 as shown in FIG. 1.

In the release state, the container-side juncture 64-to-the holding member-side juncture 71 coupling is disengaged, and the toner replenishing port 66 of the toner replenishing container 2 is blocked by the toner replenishing port shutter member 65 into the closed state. In the above-described toner replenishing container 2 retaining state as shown in FIG. 4, as the retaining member 53 is tilted to assume the release position; that is, as the retaining member 53 is tilted toward axially the other side of the toner replenishing roller 61, the retaining member 53 is allowed to move rotationally about the axis of rotation 57*a*, and the hook portion 56 formed in the retaining member 53 is allowed to move rotationally about the axis of rotation 57*a* correspondingly. Upon engagement with the engagement portion 58 disposed on the side wall of the container main body 2*a* of the toner replenishing container 2, the hook portion 56 starts to pull the toner replenishing container 2.

As shown in FIG. 8, the engagement portion 58, in which are formed the first engaging pawl 58*a* and the second engaging pawl 58*b* in a plane-symmetrical manner, is so configured that the hook portion 56 is restricted in its movement in the axial and turning directions upon engagement with the engaging pawls. As the bottom-face projection 59 is moved upwardly along the slope of the slant part 74 for guiding the toner replenishing container upwardly from the placement surface portion 73 of the container holding member 51, the toner replenishing container 2 is lifted up. Thus, in this embodiment, the displacement mechanism 80 functions as a lift-up mechanism for lifting the toner replenishing container 2 up.

In this way, according to this embodiment, by the displacement mechanism 80, the toner replenishing container 2 is displaced from the position with the toner replenishing container 2 retained by the container holding member 51. Specifically, by the displacement mechanism 80, the toner replenishing container 2 is displaced in the direction toward the opened side of the container holding member 51. This helps facilitate the removal of the toner replenishing container 2 from the container holding member 51, wherefore the need to form a grip in the toner replenishing container 2 for ease in its removal from the container holding member 51 can be eliminated. In addition, there is no need to create an extra space between the toner replenishing container 2 and the container holding member 51 for ease in the removal of the toner replenishing container 2. It is essential only that the toner replenishing container 2 and the container holding member 51, for example, the second toner replenishing container 2 and the first, second partition plates 51*a*, 51*b* be spaced apart in such a manner that, as has already been described, the spacing between the first partition plate 51*a* and the second partition plate 51*b* is slightly larger than the outside dimension of the toner replenishing container 2 in the widthwise direction. Specifically, it is essential only that the second toner replenishing container 2 and the first, second partition plates 51*a*, 51*b* be spaced apart to such an extent that they are just barely out of contact with each other. In this case, in contrast to the conventional art construction, the toner replenishing apparatus 50 can be down-sized. With the provision of such a down-sized toner replenishing apparatus 50, it is possible to reduce the size of the image forming apparatus 100.

The lift-up mechanism of this embodiment, which is the displacement mechanism 80 capable of lifting the toner replenishing container 2 up, can be realized by using only the hook portion 56 formed in the retaining member 53 and the engagement portion 58 formed in the toner replenishing container 2. However, as practiced in this embodiment, preferably the lift-up mechanism further includes the guide portion 78. In this embodiment, the guide portion 78 has the slant part 74 formed in a bend-free configuration, namely a curved-surface configuration, the inclination angle of which with respect to the placement surface portion 73 becomes larger gradually from a virtual plane including the placement surface portion 73 to the highest position farthest away from the bottom portion 76. With use of such a guide portion 78, the toner replenishing container 2 can be displaced smoothly, wherefore detachment, namely removal of the toner replenishing container 2 can be achieved smoothly. Moreover, it is possible to prevent interruption of displacement of the toner replenishing container 2 and thereby allow the toner replenishing container 2 to be displaced more reliably. Particularly, as practiced in this embodiment, in the case where the slant part 74 is formed in a curved-surface configuration and its inclination angle with respect to the placement surface portion 73 becomes larger as a distance from the virtual plane including the placement surface portion 73 becomes larger, interruption of displacement of the toner replenishing container 2 can be prevented more reliably. This assures more reliable displacement of the toner replenishing container 2.

Moreover, in this embodiment, the guide portion 78 has the horizontal part 60 extending from the highest position of the slant part 74, namely the position farthest away from the bottom portion 76, toward axially the other side of the container holding member 51, namely the support portion 77 for supporting the retaining member 53. In this case, even if a user moves his/her hands off the retaining member 53 at the release position, it never occurs that the toner replenishing container 2 slides off along the slant part 74. Accordingly, the toner replenishing container 2 can be removed more easily. For example, a person in charge of operation is able to take out the toner replenishing container 2, with his/her hands kept away from the retaining member 53. That is, the toner replenishing container 2-removal operation can be conducted with one hand.

Moreover, in this embodiment, the displacement mechanism 80 operates in conjunction with the release of the toner replenishing container 2 from the retaining action of the retaining member 53. Therefore, the release of the toner replenishing container 2 from the retaining action of the retaining member 53 and the displacement of the toner replenishing container 2 by the displacement mechanism 80 can be effected at a single stroke. Accordingly, as compared with a case where the displacement mechanism 80 does not operate in conjunction with the release of the toner replenishing container 2 from the retaining action of the retaining member 53, the toner replenishing container 2 can be removed more easily.

In this embodiment, particularly, a series of actions during the time interval between the toner replenishing container 2 retaining state as shown in FIG. 4 and the toner replenishing container 2 release state as shown in FIG. 7 can be effected solely by operating the retaining member 53. That is, the closing of the toner replenishing port 66, the disengagement of the coupling between the container-side juncture 64 and the holding member-side juncture 71, and the lifting-up of the toner replenishing container 2 can be achieved at one time. Accordingly, the toner replenishing container 2 can be removed more easily.

Moreover, since the toner replenishing port 66 can be kept in the closed state, it is possible to prevent toner leakage through the toner replenishing port 66 and thereby take the toner replenishing container 2 out without causing any contamination due to toner. Accordingly, the toner replenishing container 2 can be removed more easily.

Moreover, in this embodiment, the displacement mechanism 80 effects displacement of the toner replenishing container 2 by causing the hook portion 56 formed in the retaining member 53 to be engaged with the engagement portion 58 formed in the toner replenishing container 2. In this way, the displacement mechanism 80 can be designed in a simple configuration. Particularly, in this embodiment, the retaining member 53 is turnably supported by the container holding member 51. By the turning movement of the retaining member 53 with respect to the container holding member 51, the toner replenishing container 2 is released from the retaining action, and the hook portion 56 is engaged with the engagement portion 58 thereby to displace the toner replenishing container 2. This makes it possible to design the displacement mechanism 80 in a simpler configuration.

While, in this embodiment, the lift-up action of the displacement mechanism 80 is produced by the turning movement of the retaining member 53, there is no particular limitation. For example, the lift-up action of the displacement mechanism 80 can be produced by a sliding movement of the toner replenishing container 2. That is, the displacement mechanism 80 can be formed so as to include a sliding mechanism for sliding the toner replenishing container 2 in lieu of the turnable retaining member 53 and the engagement portion 58 which is engaged with the hook portion 56 formed in the retaining member 53. In this embodiment, as has already been described, the displacement mechanism 80 includes the guide portion 78, and the guide portion 78 includes the slant part 74 formed in the container holding member 51. Therefore, the lift-up action can be produced simply by operating the sliding mechanism to slide the toner replenishing container 2. In this way, the lifting-up of the toner replenishing container 2 can be achieved by its sliding movement. However, from the high reliability standpoint, it is desirable to adopt the method that exploits the turning movement of the retaining member 53 to achieve lifting-up as adopted in this embodiment.

Returning to FIG. 2, the image forming apparatus 100 comprises the toner replenishing apparatus 50 thus far described; image forming units 9 to 12; an intermediate transfer unit 41; a fixing unit 16; a paper-feeding cassette 13; and a paper conveying section 40. With the image forming apparatus 100 emplaced on a horizontal plane, the intermediate transfer belt 5 of the intermediate transfer unit 41 is located below the toner replenishing apparatus 50 and is located above the image forming units 9 to 12. Moreover, the paper-feeding cassette 13 is located below the image forming units 9 to 12, and the paper conveying section 40 is located alongside the toner replenishing apparatus 50, the intermediate transfer belt 5, and the image forming units 9 to 12.

The image forming apparatus 100 is built as a tandem system-type color image forming apparatus and includes a plurality of image forming units, specifically, in this embodiment, four image forming units 9 to 12. More specifically, there are provided a first image forming unit 9 for forming a black-color toner image, the second image forming unit 10 for forming a cyan-color toner image, a third image forming unit 11 for forming a magenta-color toner image, and a fourth image forming unit 12 for forming an yellow-color toner image.

As has already been described, the toner replenishing apparatus 50 includes the first to fourth toner replenishing containers 1 to 4. The first toner replenishing container 1, in which is housed a black toner, replenishes the black toner to the developing device 22 of the first image forming unit 9. The second toner replenishing container 2, in which is housed a cyan toner, replenishes the cyan toner to the developing device 22 of the second image forming unit 10. The third toner replenishing container 3, in which is housed a magenta toner, replenishes the magenta toner to the developing device 22 of the third image forming unit 11. The fourth toner replenishing container 4, in which is housed an yellow toner, replenishes the yellow toner to the developing device 22 of the fourth image forming unit 12.

The intermediate transfer unit 41 includes the intermediate transfer belt 5, two pieces of support rolls 6, a plurality of, specifically, in this embodiment, four pieces of primary transfer rollers 7, and a secondary transfer roller 8.

The intermediate transfer belt 5 is stretched across the two support rolls 6, namely a first support roll **6*a* and a second support roll 6*b*. As the first support roll 6*a* is rotatably driven, the intermediate transfer belt 5 turns in a turning direction indicated by an arrow R. The second support roll 6*b* is rotated dependently with the rotation of the first support roll 6*a*. The secondary transfer roller 8 is disposed face to face with the second support roll 6*b*, with the intermediate transfer belt 5 lying therebetween. Hereinafter, a location S where the second support roll 6*b* and the secondary transfer roller 8 confront each other is referred to as "the secondary transfer location", and opposite side directions with respect to the secondary transfer location S along the turning direction R of the intermediate transfer belt 5 are defined as "upstream side" and "downstream side", respectively. In constituting the intermediate transfer belt 5**, for example, it is possible to use a material containing an adequate amount of electrically conductive substance having electron conductivity into a resin such as polyimide or polyamide.

The four image forming units 9 to 12 are arranged, from the upstream side to the downstream side along the turning direction R of the intermediate transfer belt 5, in the following order: the first image forming unit 9 for black color; the second image forming unit 10 for cyan color; the third image forming unit 11 for magenta color; and the fourth image forming unit 12 for yellow color.

On the inner space surrounded by the intermediate transfer belt 5 are arranged the primary transfer rollers 7 face to face with their respective image forming units 9 to 12, for transferring unicolor toner images formed by the image forming units 9 to 12, respectively, onto the intermediate transfer belt 5. The unicolor toner images formed by the image forming units 9 to 12 are superimposedly transferred onto the intermediate transfer belt 5 one after another thereby to form a single color image.

At a position downstream from the fourth image forming unit 12 for yellow color in the turning direction R of the intermediate transfer belt 5, there is disposed the secondary transfer roller 8 for transferring the color image formed on the intermediate transfer belt 5 onto a recording medium, for example, a paper sheet.

The paper-feeding cassette 13 accommodates a recording medium, for example, a paper sheet. The paper sheet placed in the paper-feeding cassette 13 is conveyed in a conveyance direction indicated by an arrow P by a paper-feeding roller 14 and a plurality of conveying rollers 15 of the paper conveying section 40 so as to reach the secondary transfer location S where the secondary transfer roller 8 confronts the intermediate transfer belt 5.

At a position downstream from the secondary transfer roller 8 in the paper conveyance direction P, there is disposed the fixing unit 16 for fixing the color image transferred onto the paper sheet into place. At a position further downstream from the fixing unit 16 in the paper conveyance direction P, there is disposed a paper-discharge roller 17 for allowing the paper sheet having fixed thereon the color image to be discharged from the image forming apparatus 100. The paper-feeding roller 14, the conveying rollers 15, and the paper-discharge roller 17 constitute the paper conveying section 40.

According to the image forming apparatus 100, the unicolor toner images formed by the image forming units 9 to 12 are transferred onto the intermediate transfer belt 5 one on top of another thereby to form a color image on the intermediate transfer belt 5. The color image formed on the intermediate transfer belt 5 is, at the secondary transfer location S, secondary-transferred onto the paper sheet conveyed by the paper-feeding roller 14 and the conveying rollers 15, and is then fixed onto the paper sheet by the fixing unit 16. The paper sheet having fixed thereon the color image is discharged from the image forming apparatus 100 onto the top cover 18 by the paper-discharge roller 17.

Figure 9:
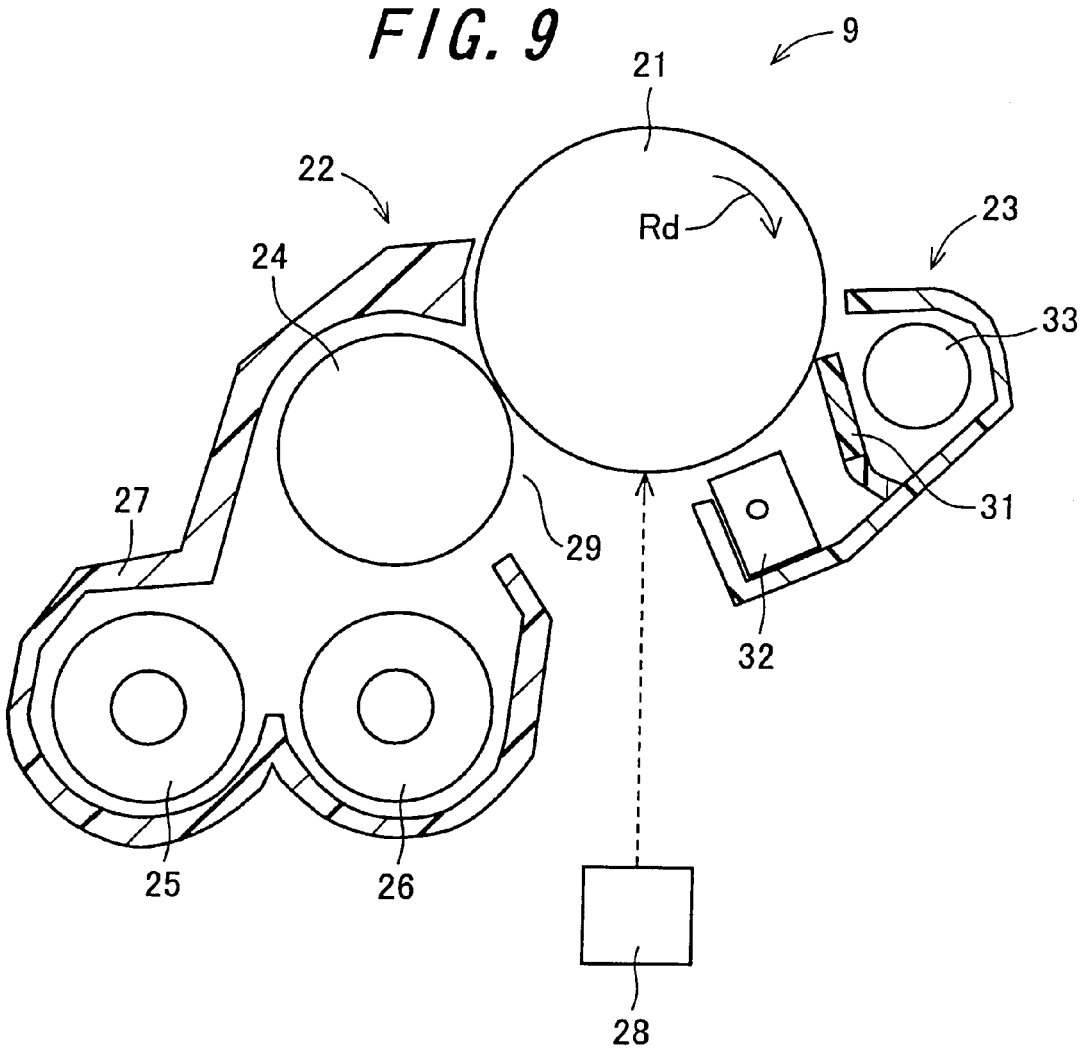
FIG. 9 is a sectional view showing a first image forming unit depicted in FIG. 2.

FIG. 9 is a sectional view showing the first image forming unit 9 depicted in FIG. 2. The second image forming unit 10, the third image forming unit 11, and the fourth image forming unit 12 have basically the same structure as the first image forming unit 9, the only difference being the color of the toner housed in the developer tank 27 of the developing device 22. Therefore, the first image forming unit 9 will be described below by way of a representative example, and the detailed descriptions of the second image forming unit 10, the third image forming unit 11, and the fourth image forming unit 12 will be omitted.

The first image forming unit 9 comprises a columnar photoreceptor drum 21 which is so disposed as to be rotatable about its axis; a charging device 32 for charging the photoreceptor drum 21; an exposure device 28 for writing an electrostatic latent image on the photoreceptor drum 21; the developing device 22 for developing the electrostatic latent image formed on the photoreceptor drum 21 into a visual image; and a photoreceptor-drum cleaner 23 for removing residues including toner that remain on the photoreceptor drum 21 following the primary transfer process. In the area surrounding the photoreceptor drum 21 are arranged, from the upstream side to the downstream side along a direction in which the photoreceptor drum 21 is rotated, the charging device 32, the exposure device 28, the developing device 22, and the photoreceptor-drum cleaner 23 in this order. The photoreceptor drum 21 corresponds to the image bearing member, and the charging device 32 and the exposure device 28 correspond to the latent-image forming section.

The charging device 32, which is realized by using for example a non-contact type charger, specifically, a scorotron charger, performs corona discharge on the photoreceptor drum 21 so that it can be charged at a predetermined potential. The charging device 32 can also be realized by using another non-contact type charger such as a corotron charger, or by using contact type charger such as a charging roller and a charging brush.

The exposure device 28, which is realized by using for example a laser exposure device, performs exposure by means of laser scanning on the basis of image signals to vary the surface potential of the photoreceptor drum 21 charged by the charging device 32. In this way, electrostatic latent images can be formed in accordance with image data. As the exposure device, it is possible to employ an LED array device or the like.

The developing device 22 effects development of the electrostatic latent image formed on the photoreceptor drum 21 with use of a toner-containing developer. In this embodiment, the developing device 22 is a two-component developer developing device for effecting latent-image development with use of a two-component developer composed of toner and carrier. The developing device 22 includes the developer tank 27 in which is housed a two-component developer, a developing roller 24, a first agitating roller 25 and a second agitating roller 26. The developer tank 27 has an opening 29 formed face to face with the outer peripheral surface of the photoreceptor drum 21. Within the developer tank 27 are disposed the developing roller 24, the first agitating roller 25, and the second agitating roller 26 face to face with the opening 29. The developing roller 24 supplies the two-component developer to the photoreceptor drum 21 while conveying the developer borne on its outer peripheral surface. The first and second agitating rollers 25 and 26 agitate the developer. The developing roller 24 is spaced away from the outer peripheral surface of the photoreceptor drum 21.

The photoreceptor-drum cleaner 23 has a cleaning blade 31 and a conveying paddle roller 33. The cleaning blade 31 made for example of urethane rubber is disposed, in a location where the circumferential surface of the photoreceptor drum 21 rotates downwardly in a rotation direction Rd; that is, the circumferential surface of the photoreceptor drum 21 assumes a downward rotation direction Rd, so as to be brought into pressure-contact with the photoreceptor drum 21 in a counter-Rd direction, namely a direction reverse to the downward rotation direction Rd of the photoreceptor drum 21. With this arrangement, residues remaining on the surface of the photoreceptor drum 21 can be scraped off with the cleaning blade 31.

As described heretofore, the image forming apparatus 100 is designed to allow easy removal of the toner replenishing containers 1 to 4 and is also provided with the toner replenishing apparatus 50 that can be down-sized. Accordingly, it is possible to realize a compact image forming apparatus 100 that allows easy replacement of the toner replenishing containers 1 to 4.

Especially, being built as a color image forming apparatus, the image forming apparatus 100 of this embodiment necessitates a plurality of toner replenishing containers 1 to 4. In this regard, the toner replenishing apparatus 50 of this embodiment is so designed that the toner replenishing containers 1 to 4 can be removed easily therefrom without the necessity of forming a grip or creating an extra space around the toner replenishing container for ease in the removal, as described previously. Accordingly, it is possible to realize a compact color image forming apparatus 100 that allows easy replacement of the individual toner replenishing containers.

In the embodiment thus far described, the toner replenishing apparatus 50 serves to replenish toner only. However, in a case where the developing device 22 is built as a developing device utilizing a trickle development system that requires successive carrier replacement, the toner replenishing apparatus 50 can be designed to replenish both toner and carrier. In this case, the toner replenishing containers 1 to 4 each accommodate toner and carrier.

Moreover, in this embodiment, the four image forming units 9 to 12 are arranged, from the upstream side to the downstream side along the turning direction R of the intermediate transfer belt 5, in the following order: the first image forming unit 9 for black color; the second image forming unit 10 for cyan color; the third image forming unit 11 for magenta color; and the fourth image forming unit 12 for yellow color. However, there is no particular limitation and therefore, for example, the image forming units 9 to 12 can be arranged, from the upstream side to the downstream side along the turning direction R of the intermediate transfer belt 5, in the following order: the fourth image forming unit 12 for yellow color; the third image forming unit 11 for magenta color; the second image forming unit 10 for cyan color; and the first image forming unit 9 for black color.

In addition, in the embodiment thus far described, the image forming apparatus is a color image forming apparatus having four toner replenishing containers 1 to 4 and four displacement mechanisms 80 on the container holding member 51 to replenish toners of different colors to four image forming unit 9 to 12, respectively. However, the image forming apparatus of the invention is not limited thereto, but may be a monochrome image forming apparatus having a single toner replenishing container and a single displacement mechanism to replenish toner a single image forming unit.

Further, the image forming apparatus of this embodiment is built as a printer, and more specifically a laser printer in which a photoreceptor is subjected to laser light exposure. However, the image forming apparatus of the invention is not limited thereto, but may be of another type so long as it is an image forming apparatus equipped with a developing device for developing a latent image, for example, an electrostatic latent image or a magnetic latent image with use of a toner-containing developer. For example, the image forming apparatus may be built as a copying machine such as an electrostatic copier or a facsimile machine.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner replenishing apparatus comprising:

a toner replenishing container for accommodating toner to be replenished to a developing device;

a container holding member for holding the toner replenishing container in a detachable manner;

a displacement mechanism for displacing the toner replenishing container from a position where the toner replenishing container is held by the container holding member; and a retaining member for retaining the toner replenishing container securely in the container holding member, wherein the displacement mechanism effects displacement of the toner replenishing container in conjunction with a release of the toner replenishing container from a retaining action of the retaining member, and the displacement mechanism includes a hook portion formed in the retaining member and an engagement portion formed in the toner replenishing container, the engagement portion being engaged with the hook portion under a condition that the toner replenishing container is released from the retaining action of the retaining member.

2. The toner replenishing apparatus of claim 1, wherein the retaining member is turnably supported by the container holding member, and the toner replenishing container is released from a retaining action by a turning movement of the retaining member with respect to the container holding member.

3. The toner replenishing apparatus of claim 2, wherein the container holding member is formed in a shape of a housing having a bottom portion and a wall portion with its one side opened, the bottom portion has a placement surface portion on which is placed the toner replenishing container while being retained in place by the retaining member, the wall portion has a guide portion merged with the placement surface portion for guiding the toner replenishing container in a direction toward the opened side of the container holding member and a support portion merged with the guide portion for supporting the retaining member, the displacement mechanism further includes the guide portion, and the hook portion and the engagement portion are engaged with each other to displace the toner replenishing container in the direction toward the opened side of the container holding member.

4. The toner replenishing apparatus of claim 3, wherein the guide portion has a slant part which merges with the placement surface portion and is inclined to the placement surface portion, and a horizontal part which merges with the slant part and is parallel to the placement surface portion.

5. The toner replenishing apparatus of claim 4, wherein the slant part is formed in a curved-surface configuration, and its inclination angle with respect to the placement surface portion becomes larger as a distance from a virtual plane including the placement surface portion becomes larger.

6. The toner replenishing apparatus of claim 1, wherein the toner replenishing container has a toner replenishing section which is driven to rotate about a predetermined axis of rotation, for replenishing toner to the developing device, and a container-side juncture for transmitting a rotational drive force to the toner replenishing section, the container holding member has a holding member-side juncture which is coupled to the container-side juncture, in a state where the toner replenishing container is retained in the container holding member, to transmit a rotational drive force to the container-side juncture, and a coupling between the container-side juncture and the holding member-side juncture is disengaged in conjunction with the displacement of the toner replenishing container by the displacement mechanism.

7. An image forming apparatus comprising:

an image bearing member on which is to be formed a latent image;

a latent-image forming section for forming a latent image on the image bearing member;

a developing device for developing the latent image formed on the image bearing member with use of toner; and the toner replenishing apparatus of claim 1 for replenishing toner to the developing device.

8. A toner replenishing apparatus comprising:

a toner replenishing container for accommodating toner to be replenished to a developing device;

a container holding member for holding the toner replenishing container in a detachable manner;

a displacement mechanism for displacing the toner replenishing container from a position where the toner replenishing container is held by the container holding member; and a shutter section for opening and closing a toner replenishing port which is formed in the toner replenishing container for replenishing toner to the developing device, wherein the shutter section brings the toner replenishing port into a closed state in conjunction with the displacement of the toner replenishing container by the displacement mechanism.

9. A color image forming apparatus comprising:

a plurality of image bearing members on each of which is to be formed a latent image;

a plurality of latent-image forming sections each for forming a latent image on the image bearing member;

a plurality of developing devices each for developing the latent image formed on the image bearing member with use of toner, the toners used for the respective developing devices being of different colors from each other;

a plurality of toner replenishing containers each for accommodating toner to be replenished to a developing device corresponding thereto;

a container holding member for holding the plurality of toner replenishing containers in a detachable manner; and a plurality of displacement mechanisms each for displacing the corresponding toner replenishing container from a position where the corresponding toner replenishing container is held by the container holding member; and a plurality of shutter sections for opening and closing toner replenishing ports which are formed in the toner replenishing containers for replenishing toner to the developing device, wherein the shutter sections bring the toner replenishing ports into a closed state in conjunction with the displacement of the toner replenishing containers by the displacement mechanisms.

* * * * *